US006276556B1

(12) United States Patent
Ungar

(10) Patent No.: US 6,276,556 B1
(45) Date of Patent: Aug. 21, 2001

(54) PRODUCT STUFFER

(75) Inventor: Istvan Ungar, Mississauga (CA)

(73) Assignee: Langen Packaging Inc., Ontario (CA)

( * ) Notice: Subject to any disclaimer, the term of this patent is extended or adjusted under 35 U.S.C. 154(b) by 0 days.

(21) Appl. No.: 09/277,165

(22) Filed: Mar. 26, 1999

(51) Int. Cl.[7] ..... B65D 6/40
(52) U.S. Cl. ..... 220/608; 220/671
(58) Field of Search ..... 53/252, 530, 542; 220/608, 671, 6, 675; 193/2 R, 46

(56) References Cited

U.S. PATENT DOCUMENTS

| | | | | |
|---|---|---|---|---|
| 786,674 | * | 4/1905 | Polski . | |
| 2,607,509 | * | 8/1952 | Hess . | |
| 3,408,234 | * | 10/1968 | Ririe . | |
| 3,409,115 | | 11/1968 | Porcaro . | |
| 3,438,475 | * | 4/1969 | Toney . | |
| 4,256,174 | * | 3/1981 | Yoshida . | |
| 4,602,709 | * | 7/1986 | Ueda | 193/2 R |
| 5,048,707 | * | 9/1991 | Hallberg | 220/4.21 |
| 5,671,855 | * | 9/1997 | Norman, Jr. et al. | 220/1.5 |
| 5,673,791 | * | 10/1997 | Jamison | 206/508 |

FOREIGN PATENT DOCUMENTS 296 889 1/1972 (AT) .

* cited by examiner

*Primary Examiner*—Stephen Castellano
(74) *Attorney, Agent, or Firm*—Antonelli, Terry, Stout & Kraus, LLP

(57) ABSTRACT

A product stuffer has a bucket train, a carton conveyor which, at a stuffing station, parallels the bucket train and is arranged for conveying a carton adjacent to, and in registration with, an outlet end of a bucket in the bucket train, and a product pusher train which, at the stuffing station, parallels said bucket train and is arranged for providing a product pusher adjacent to, and in registration with, an inlet end of a bucket in the bucket train. Each bucket in the bucket train is open-ended and has a floor with a plurality of parallel grooves which slope toward one sidewall of the bucket and a ceiling with a plurality of parallel grooves which slope away from the one sidewall. Consequently, products in a sheaf of upstanding products inserted into the bucket are urged to lean over as the sheaf is pushed through the bucket so that a shingled sheaf of products leaves the bucket. The shingled sheaf may be stuffed into a carton having a lesser height than that of a sheaf of upstanding products.

15 Claims, 3 Drawing Sheets

PRODUCT STUFFER

FIELD OF THE INVENTION

This invention relates to a bucket and a product stuffer utilising the bucket.

BACKGROUND OF THE INVENTION

Product stuffers are known which push a sheaf of products from an open-ended bucket into a carton. While these are suitable where the sheaf of products has a height no greater than the height of the carton, they cannot be used to stuff a sheaf of products into cartons having a lesser height than the sheaf.

SUMMARY OF THE INVENTION

The present invention provides an open-ended bucket with co-operating features on opposed walls which re-orient products in a sheaf of products so that the height of the sheaf is changed. This can, for example, be used to tilt products in a sheaf of upstanding products over to form a sheaf of shingled products so that the sheaf of shingled products can be stuffed into a carton having a height less than the height of the sheaf of upstanding products.

Accordingly, the present invention comprises a bucket comprising: first and second substantially opposite walls extending between an open inlet end and an open outlet end, each of said walls having cooperating features arranged such that a sheaf of products moved through said bucket in a direction from said inlet end to said outlet end is urged by engagement with said features to twist about an axis substantially parallel to said direction, thereby to reorient the products as they are moved through the bucket.

BRIEF DESCRIPTION OF THE DRAWINGS

In the drawings which illustrate an example embodiment of the invention.

DETAILED DESCRIPTION OF THE PREFERRED EMBODIMENTS

Figure 1:
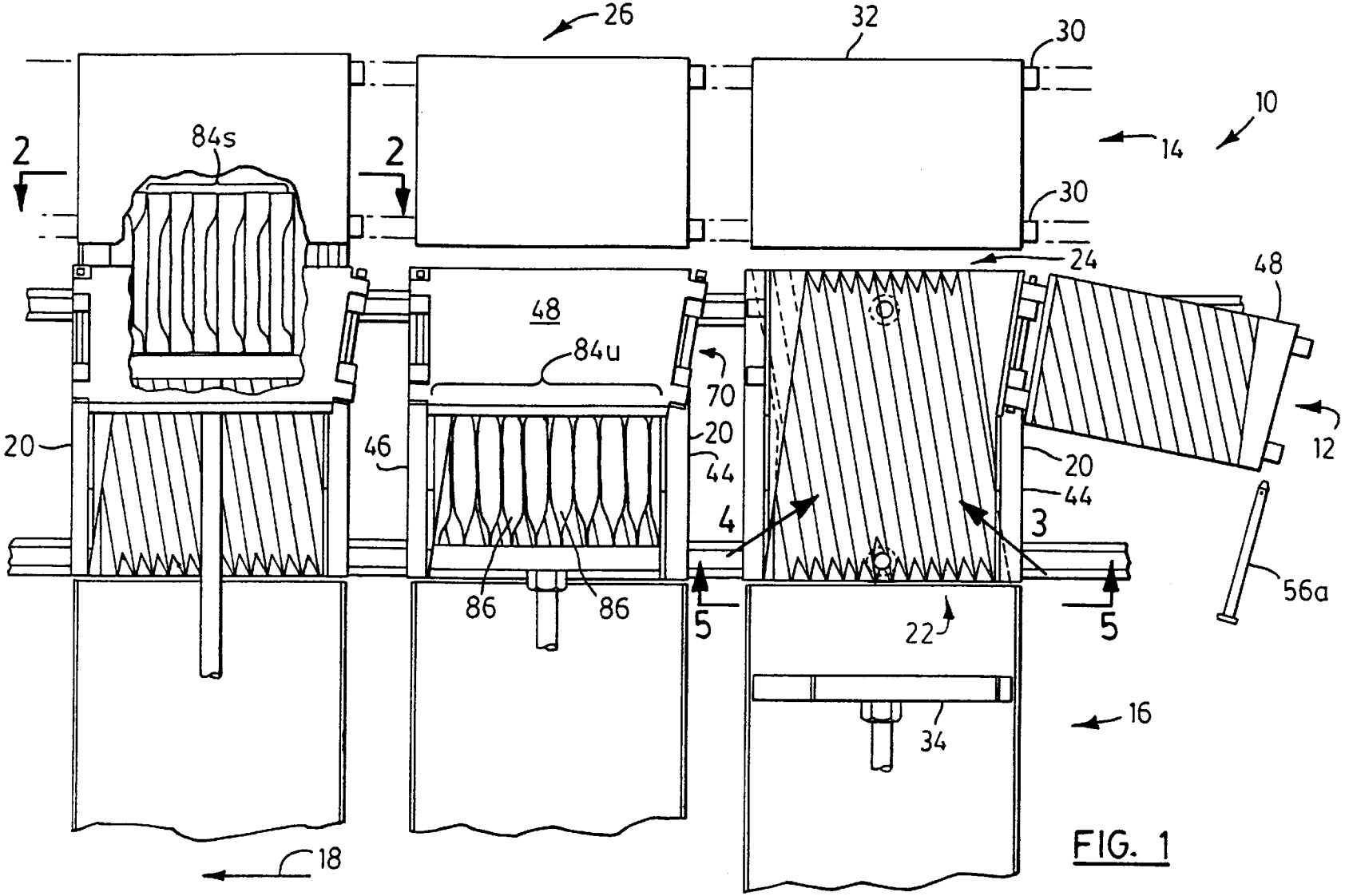
FIG. 1 is a plan view of a product stuffer made in accordance with the invention partially cut-away and partially in exploded view.
Figure 2:
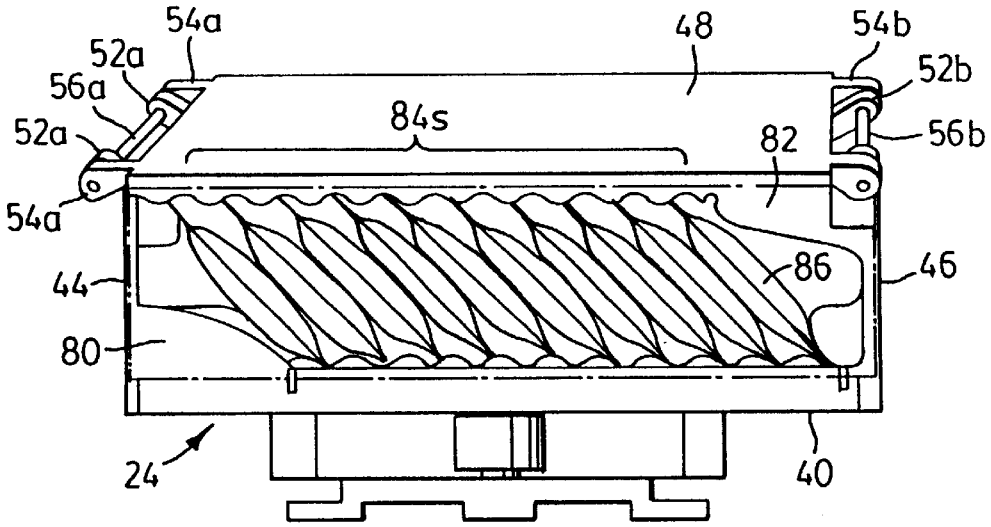
FIG. 2 is a view along the lines 2—2 of FIG. 1.

Turning to FIG. 1, a product stuffer 10 comprises a bucket train 12, a carton conveyor 14 and a product pusher train 16 moving continuously in a downstream direction 18. The buckets 20 in the train 12 are open-ended, having an inlet end 22 and an outlet end 24. At the product stuffing station shown in FIG. 1, the carton conveyor 14 is parallel to the bucket train 12 and is adjacent the outlet end 24 of the buckets. Further, the lugs 30 moving the cartons are positioned so that each carton 32 carried by the carton conveyor 14 at the stuffing station is registered with the outlet end 24 of one bucket 20. At the stuffing station, the pusher train 16 is also parallel to the bucket train 12 but is adjacent the inlet end 22 of the buckets. Each pusher 34 at the stuffing station is registered with the inlet end 22 of one bucket.

Referencing FIGS. 2 to 5 along with FIG. 1, each bucket 20 has a U-shaped body 40 which defines a floor 42 and opposite sidewalls 44, 46. Each bucket also has a roof member 48 which, when closed, defines a ceiling 50 for the bucket 20. The outside of sidewall 44 has hinge mounts 52*a* which, with hinge mounts 54*a* of the roof member 48, may receive a hinge pin 56*a* to pivotably mount one side of the roof member to sidewall 44. Roof member may be pivoted closed so that hinge mounts 54*b* on its opposite side align with hinge mounts 52*b* on sidewall 42 to receive a hinge pin 56*b* thereby locking the roof member in place on the bucket body 40.

The floor 42 of the bucket body 40 has a series of parallel ridges 60 which form a series of parallel grooves 62 between adjacent ridges. The ridges are linear (i.e., straight) and slope away from sidewall 44 such that each ridge 60 is more proximate sidewall 44 at inlet end 22 of bucket 20 and more proximate sidewall 46 at outlet end 24 of bucket 20. The ceiling 50 of roof member 48 also has a series of parallel ridges 66 which form a series of parallel grooves 68 between adjacent ridges 66. The ridges are linear and, with the roof member closed in place on the bucket body, slope toward sidewall 44. Thus, each ridge 66 is more proximate sidewall 46 toward the inlet end 22 of the bucket and more proximate sidewall 44 at the outlet end 24 of the bucket 20.

Figure 5:
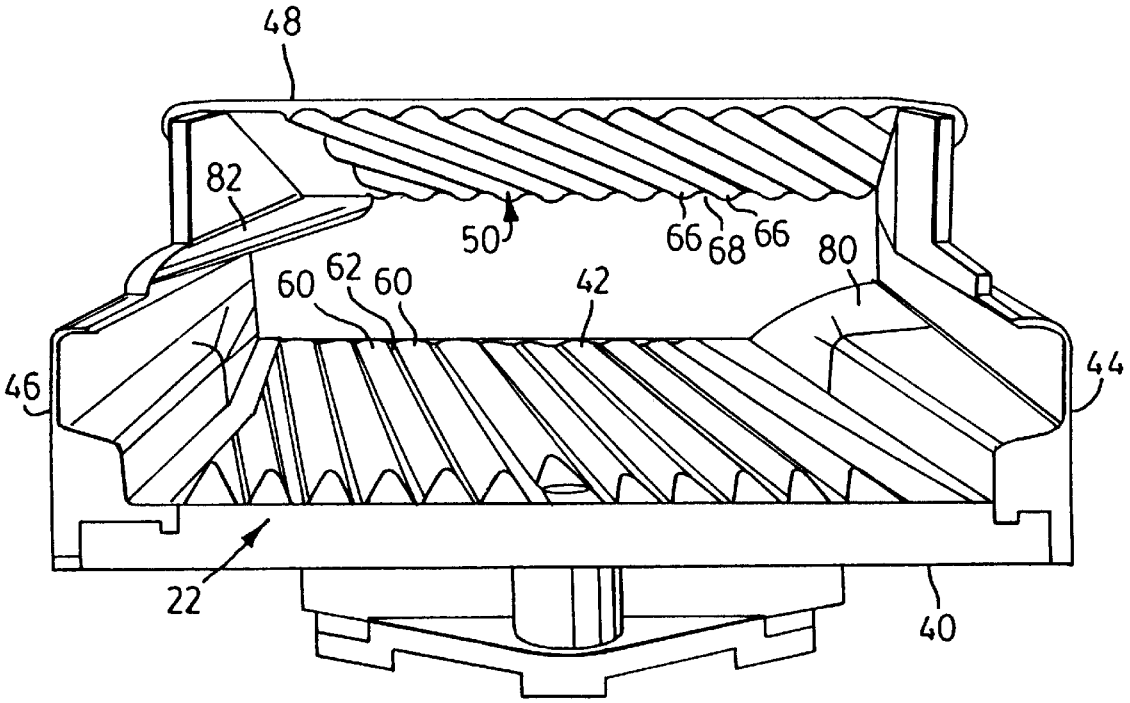
FIG. 5 is a view along the lines 5—5 of FIG. 1.
Figure 3:
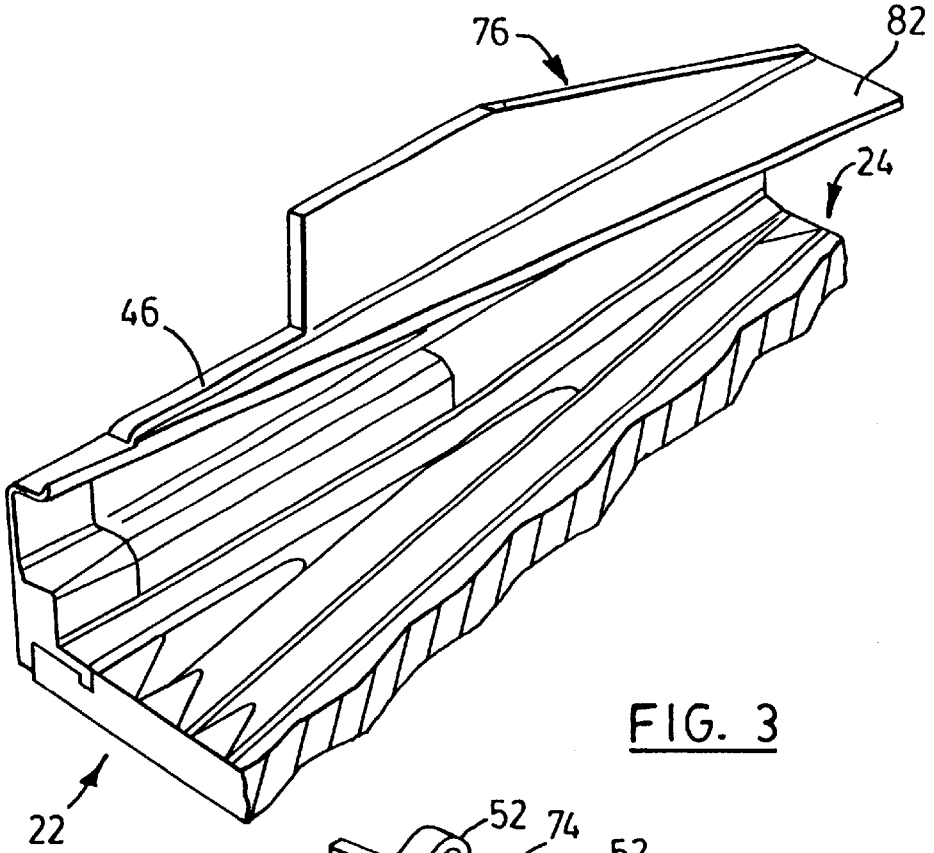
FIG. 3 is a cut-away view along the line 3 of FIG. 1.
Figure 4:
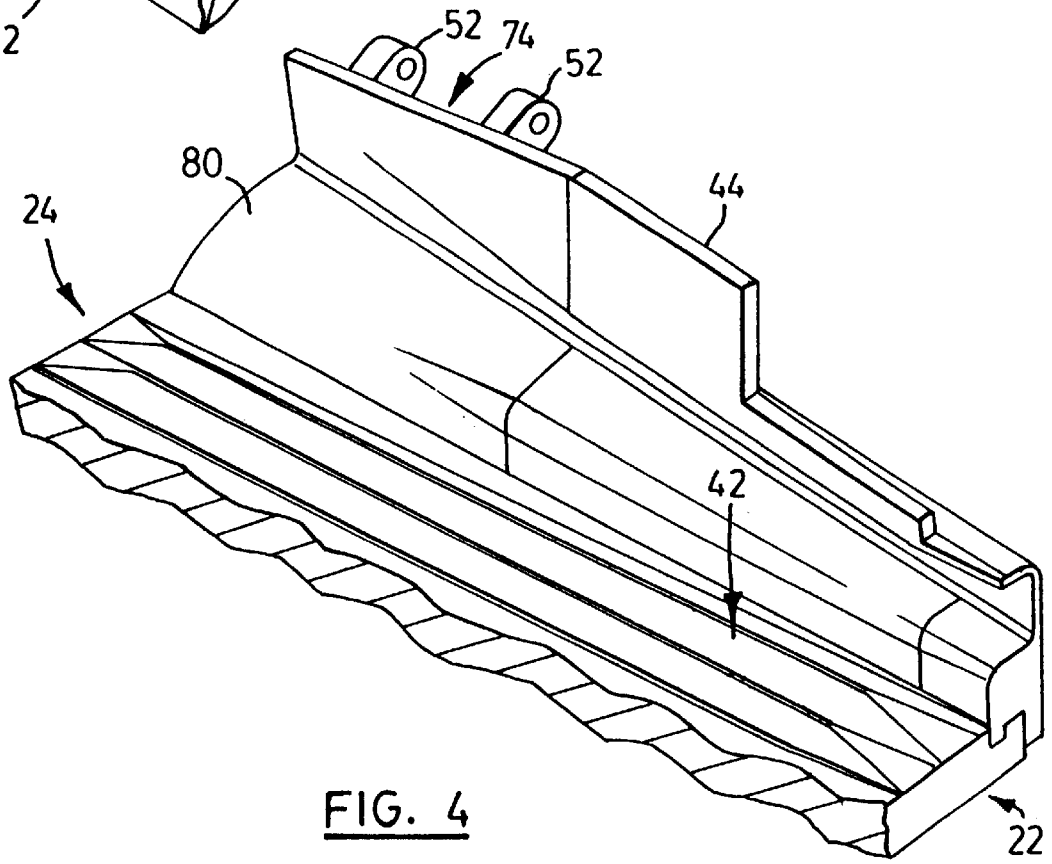
FIG. 4 is a cut-away view along the line 4 of FIG. 1.

As best seen in FIG. 1, sidewall 44 has a portion 70 extending to the outlet end of the bucket 20 which flares outwardly. In consequence, a width of the bucket between sidewalls 42, 44 increases toward the outlet end 24 of the bucket. As best seen in FIGS. 3 to 5, each sidewall 44, 46 has a tapering section 74, 76, respectively, which tapers downwardly toward the outlet end 24 of the bucket. In consequence (as seen in FIG. 5), roof member 48 angles downwardly toward the outlet end of the bucket. Thus, the height of the bucket between the floor 42 and ceiling 50 decreases toward the outlet end 24 of the bucket, As best seen in FIG. 4, a wedge-shaped abutment 80 extends from the floor 42 along sidewall 44 which widens toward the outlet end 24 of the bucket. As best seen in FIG. 3, another wedge-shaped abutment 82 extends along sidewall 46 proximate its top edge, and hence proximate ceiling 50 (FIG. 5). This abutments 82 also widens toward the outlet end 24 of the bucket.

In operation, referencing all of the figures, upstream of the product stuffing station, a sheaf 84*u* of upstanding products 86 is inserted into buckets 20 of the bucket train 12 (the product sheaf which would be present in the rightmost bucket shown in FIG. 1 has been omitted for illustration purposes), As a bucket 20 moves through the product stuffing station, a cam (not shown) cams the product pusher 34 associated with the bucket forwardly, into the bucket. This causes the pusher to push the sheaf 84*u* of products 86 in the bucket toward the outlet end 24 of the bucket. As the sheaf is pushed, the ridges and grooves of the floor tug the bottom edge of each product 86 toward sidewall 46. At the same time, the ridges and grooves of the ceiling tug the top edge of each product toward sidewall 44. The result is that the ridges and grooves of the floor and ceiling co-operate to torque each product in the sheaf so that each product leans over toward sidewall 44. The wedges 80, 82 assist the grooves and ridges in urging the products to lean toward sidewall 44. The net result is that a sheaf 84*u* of upstanding products 86 entering bucket 20 becomes a sheaf 84*s* of shingled products 86 at the outlet end 24 of the bucket. A sheaf 84*s* of shingled products is wider than a sheaf 84*u* of upstanding products. The widening of the bucket 20 toward its outlet end 24 accommodates the greater width of the sheaf 84*s*. Further, a sheaf 84*s* of shingled products has a lesser height than that of a sheaf 84*u* of upstanding products. The decreasing height of the bucket toward its outlet end thus co-operates with the ridges and grooves in ensuring that the products lean over as they move to the outlet end 24 of the bucket. Once a sheaf 84*s* of shingled products is formed, it may be stuffed into a carton 30 adjacent the outlet end 24 of the bucket. Each carton 30 has a height less than that of a sheaf 84*u* of upstanding products, but the cartons have a height, and width, suited to the shingled sheaf 84*s*.

In the off-chance that products in a sheaf jam in a bucket, a hinge pin 56*a* or 56*b* may be removed from the roof member 48 to allow the jam to be cleared.

The degree to which the products in a sheaf are tilted may be chosen by an appropriate choice for the slope of the ridges 60, 66 and for the final width and height of the bucket at its outlet end 24.

While continuous ridges and grooves are the preferred co-operating features on the floor 42 and ceiling 50, it may be possible to construct a bucket which will not result in excessive jamming with different cooperating features, such as parallel lines of bumps on the floor and ceiling. Further, while it is preferred that the parallel ridges and grooves are linear, they may instead be curved so that the tilting torque on the products increases as the products move through the bucket.

If the roof member of the bucket is extended to the inlet end of the bucket, the bucket could be used in various different orientations. For example, such a bucket could be rotated by ninety degrees such that the floor and ceiling become the bucket sidewalls.

It may be useful in some instances to re-orient a sheaf of shingled products to a sheaf of upstanding products. To do so, a sheaf of shingled products may be pushed from end 24 to end 22 of a bucket 20.

Other modifications will be apparent to those skilled in the art and, therefore, the invention is defined in the claims.

What is claimed is:

1. A bucket, comprising:

open inlet and outlet ends;

a floor with a plurality of inward facing, open parallel groove which slope away from one side wall of said bucket from said inlet end to said outlet end such that each of said grooves of said floor is more proximate said one sidewall at said inlet end than said outlet end;

a ceiling located opposite to said floor, said ceiling having a plurality of inward facing, open parallel grooves which slope toward said one side wall from said inlet end to said outlet end such that each of said grooves of said ceiling is more proximate said one sidewall at said outlet end than said inlet end.

2. The bucket of claim 1 wherein said grooves in said floor are linear and said grooves in said ceiling are linear.

3. The bucket of claim 2 wherein a height of said bucket between said floor and said ceiling decreases toward an outlet end of said bucket.

4. The bucket of claim 3 wherein said one sidewall is a first sidewall and wherein a width of said bucket between said first sidewall and an opposite second sidewall of said bucket increases toward said outlet end of said bucket.

5. The bucket of claim 4 including a wedge-shaped abutment extending from said floor along said first sidewall and widening toward said outlet end of said bucket.

6. The bucket of claim 5 including a wedge-shaped abutment extending proximate said ceiling along said second sidewall and widening toward said outlet end of said bucket.

7. The bucket of claim 6 wherein said grooves of said floor and said grooves of said ceiling extend to said outlet end.

8. The bucket of claim 7 wherein said grooves of said floor extend from said inlet end.

9. The bucket of claim 8 comprising a roof member, a bottom wall of which comprises said ceiling and wherein said roof member is removably attached to said sidewalls.

10. The bucket of claim 9 wherein said roof member and said first sidewall have co-operating hinge mounts receiving a removable hinge pin and wherein said roof member and said second sidewall have co-operating hinge mounts receiving a removable hinge pin.

11. A bucket as claimed in claim 1 wherein said grooves in said floor and in said ceiling are formed between a plurality of parallel ridges.

12. A bucket as claimed in claim 1, wherein said bucket further comprises a connector for connecting said bucket to a conveyor track.

13. A bucket as claimed in claim 1 wherein said one side wall is a first side wall extending between said floor and said ceiling and further comprising a second side wall located opposite to said first side wall and extending between said floor and said ceiling.

14. A bucket as claimed in claim 13 wherein said first and second side wall are in contact with both said floor and said ceiling.

15. A bucket comprising:

(a) a first sidewall and a second sidewall (b) a first open end and a second open end a floor having a first set of features each of said features for engaging a first side of an article, said features oriented away from said first side wall from said first end to said second end such that each of said features of said floor is more proximate said one sidewall at said first end than said second end;

a ceiling located opposite to said floor and having a first set of features each of said features for engaging a first side of all article, said features oriented toward said first side wall from said first end to said second end such that each of said features of said floor is more proximate said one sidewall at said second end than said first end.

* * * * *

UNITED STATES PATENT AND TRADEMARK OFFICE

CERTIFICATE OF CORRECTION

PATENT NO. : 6,276,556 B1
DATED : August 21, 2001
INVENTOR(S) : Istvan Ungar

It is certified that error appears in the above-identified patent and that said Letters Patent is hereby corrected as shown below:

Column 3, claim 1,
Line 40, replace "groove which slope" with -- grooves which slope --

Column 4, claim 15,
Line 50, replace "first side of all article," with -- first side of an article, --

Signed and Sealed this

Fifth Day of March, 2002

*Attest:*

*Attesting Officer*

JAMES E. ROGAN
*Director of the United States Patent and Trademark Office*